United States Patent [19]

Price

[11] 4,262,446

[45] Apr. 21, 1981

[54] HOUSEHOLD SECURITY DEVICE

[76] Inventor: William J. Price, 8 Kingfield St., London E.14 9DD, England

[21] Appl. No.: 8,000

[22] Filed: Jan. 31, 1979

[51] Int. Cl.[3] ..... E05B 65/00

[52] U.S. Cl. ..... 49/35

[58] Field of Search ..... 49/35; 70/262, 263

[56] References Cited

U.S. PATENT DOCUMENTS

| | | | |
|---|---|---|---|
| 3,444,711 | 5/1969 | Sedley | 70/276 |
| 3,595,042 | 7/1971 | Sedley | 70/276 |
| 3,633,167 | 1/1972 | Hedin | 70/278 |

FOREIGN PATENT DOCUMENTS

| | | | |
|---|---|---|---|
| 1342395 | 1/1974 | United Kingdom | 49/35 |

*Primary Examiner*—Philip C. Kannan

*Attorney, Agent, or Firm*—Daniel Jay Tick

[57] ABSTRACT

A container for accommodating an identification paper is, itself, accommodated in a receptacle mounted on the inside surface of a door. A securing device in the receptacle and the door releasably secures the container in the receptacle until released by someone on the inside of the door and retrieved by someone outside the door.

6 Claims, 10 Drawing Figures

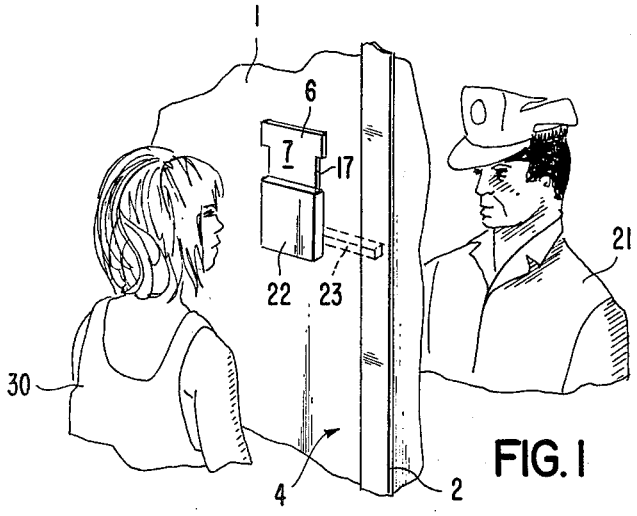
FIG. 1
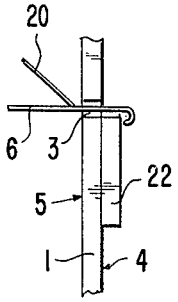
FIG. 2
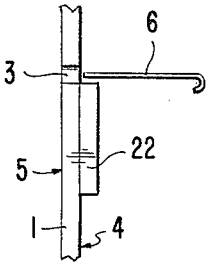
FIG. 3
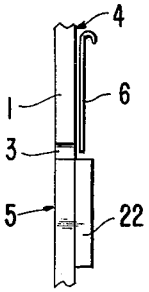
FIG. 4
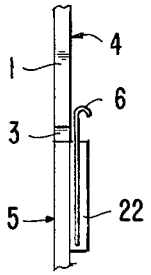
FIG. 5
FIG. 6
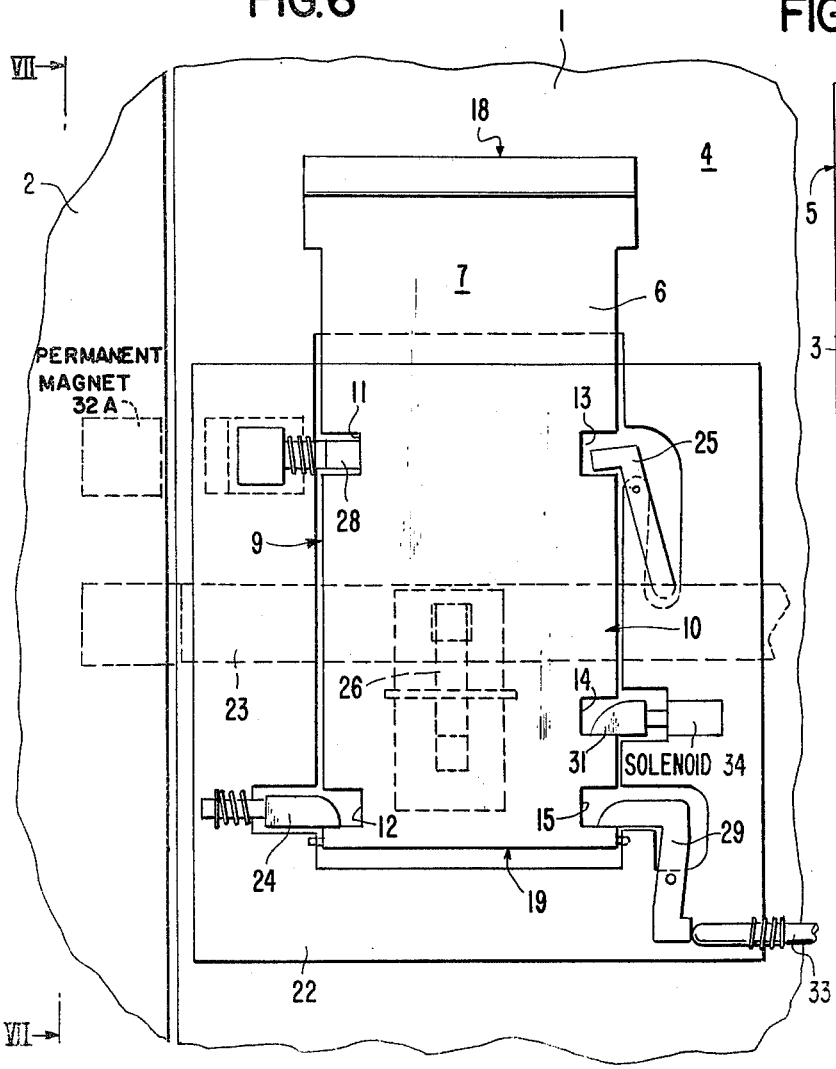
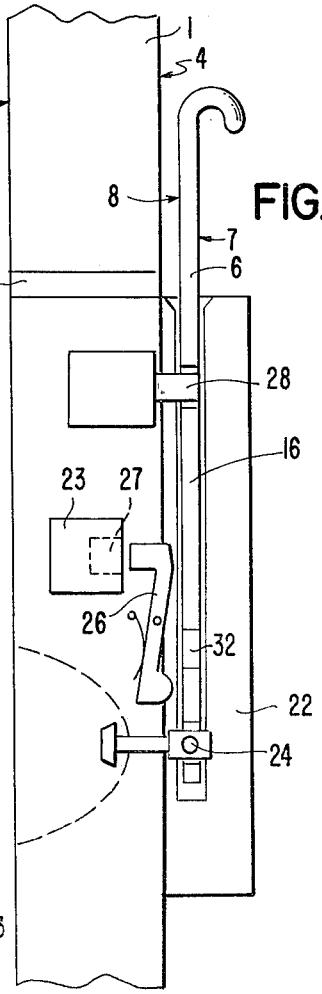
FIG. 7

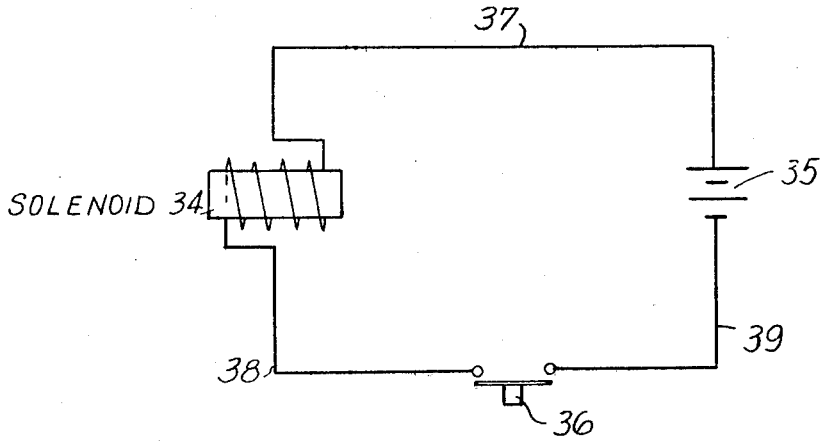
FIG. 8
FIG. 9
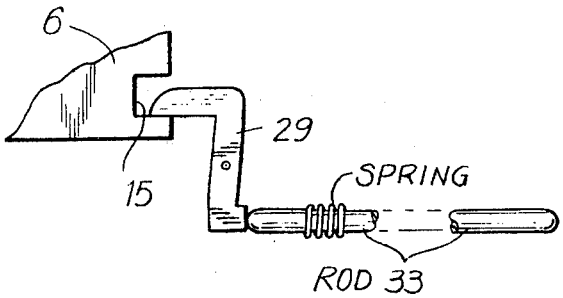
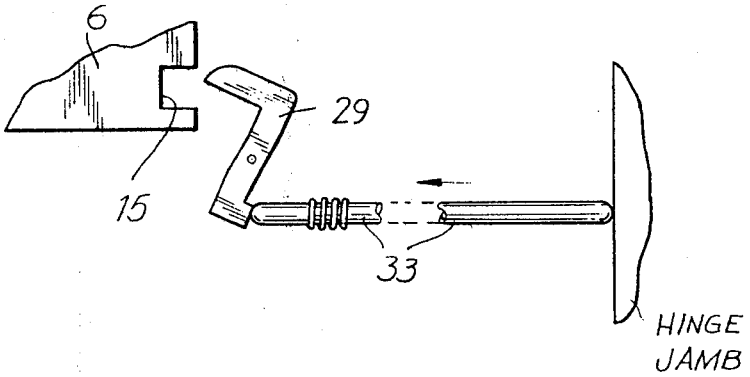
FIG. 10

HOUSEHOLD SECURITY DEVICE

BACKGROUND OF THE INVENTION

The present invention relates to a household security device. More particularly, the invention relates to a household security device for a door movably mounted in a door jamb, the door having a slot formed therethrough, an inside surface and an outside surface.

Household security devices of the type described herein are disclosed in U.S. Pat. Nos. 2,033,104; 2,070,320; 2,264,104; 2,595,769; 2,668,319; 2,722,819; 2,817,554; 3,154,761; 3,184,937; 3,444,711; 3,595,042; 3,618,517; 3,619,060; 3,633,167; 3,812,460; 3,818,443; 3,819,911; 3,834,197; 3,858,180 and 3,919,869.

Objects of the invention are to provide a household security device of simple structure, which is inexpensive in manufacture, installed with facility and convenience on doors of any type, used with facility and convenience, and functions efficiently, effectively and reliably to secure an identification paper, card, or the like, until the person inside an area enclosed by the door releases the identification paper and such identification paper is also released by a person outside the bolted door who has presented same in an effort to gain admittance, thereby insuring that a departing visitor cannot regain possession of the identification until he is outside the locked door, and with the active cooperation of the person inside the enclosed area.

BRIEF DESCRIPTION OF THE DRAWINGS

In order that the invention may be readily carried into effect, it will now be described with reference to the accompanying drawings, wherein:

FIG. 1 is a schematic diagram of an embodiment of the household security device of the invention in use;

FIG. 2 is a schematic diagram illustrating the initial placing of the identification paper in the container;

FIG. 3 is a schematic diagram illustrating the passing of the container through the slot through the door;

FIG. 4 is a schematic diagram illustrating the placing of the container in the receptacle;

FIG. 5 is a schematic diagram illustrating the securing of the container in the receptacle;

FIG. 6 is a view, on an enlarged scale, of an embodiment of the household security device of the invention;

FIG. 7 is a view, taken along the lines VII—VII, of FIG. 6;

FIG. 8 is a circuit diagram of the solenoid energizing circuit of the household security device of the invention;

FIG. 9 is a view of the fifth securing device and actuating rod of the household security device of the invention in position for preventing the container from being raised; and FIG. 10 is a view of the device and rod of FIG. 9 in position permitting the container to be raised.

DETAILED DESCRIPTION OF THE INVENTION

The household security device of the invention is for a door 1 movably mounted in a door jamb 2 (FIGS. 1 and 6). The door 1 has a slot 3 formed therethrough (FIGS. 2 to 5 and 7), an inside surface 4 and an outside surface 5 (FIGS. 2 to 5 and 7).

The security device of the invention comprises a container 6 of generally rectangular parallelepiped configuration having a pair of spaced substantially planar parallel surfaces 7 and 8 (FIG. 7), each of substantially rectangular configuration, as shown in FIGS. 1 and 6, with a pair of spaced parallel length edges 9 and 10 (FIG. 6). The length edge 9 has spaced indentations 11 and 12 formed therein and the length edge 10 has spaced indentations 13, 14 and 15 formed therein, as shown in FIG. 6. The container 6 also has a pair of length sides 16 (FIG. 7) and 17 (FIG. 1) perpendicular to the surfaces 7 and 8 and joining the corresponding edges 9 and 10 of said surfaces with indentations formed in the length sides in correspondence with the indentations formed in the edges. The container 6 also has a pair of width sides 18 and 19 perpendicular to the surfaces 7 and 8, as shown in FIG. 6.

The container 6 is not detachable from the remainder of the device. Its movement is contained by appropriately grooved pieces affixed to the body of the lock and extending into the slot 3. A pair of pins on the lower extremity of the container 6, as shown in FIG. 6, limit the travel of said container in the positions shown in FIGS. 3 and 4.

The container 6 has a chamber therein (not shown in the FIGS.) for accommodating an identification paper, card, or the like. A spring-hinged transparent cover plate 20 opens the chamber of the container 6 (FIG. 2). Thus, a person 21 (FIG. 1) desiring to gain entry to an area enclosed by the door 1 places his identification paper, card, or the like, in the container 6. The cover plate 20 closes against the hinge spring pressure as the container 6 is drawn through the slot 3 into the inside of the area (FIG. 3).

A receptacle 22 is mounted on the inside surface 4 of the door 1 which accommodates the container 6, as shown in FIGS. 1 to 7.

A door bolt 23 (FIGS. 1, 6 and 7) extends through the door 1 for releasably securing said door.

A securing system is provided in the receptacle 22 and the door 1 for releasably securing the container 6 in said receptacle. The securing system includes a first securing device 24 (FIGS. 6 and 7) cooperating with the indentation 12 of the container 6 and operated from outside the door 1. The securing system also includes second and third securing devices 25 (FIG. 6) and 26 (FIGS. 6 and 7) coupled to, and operated by, the door bolt 23 from inside the door 1. The second securing device 25 cooperates with the indentation 13 in the container 6. The third securing device 26 cooperates with an indentation 27 formed in the door bolt 23, as shown in FIG. 7. The securing system further comprises fourth and fifth securing devices 28 (FIGS. 6 and 7) and 29 (FIG. 6) cooperating with the indentations 11 and 15, respectively, and operated from inside the door 1 when said door is closed. Thus, after the visitor 21 places an indentification paper, card, or the like, in the container 6 outside the door 1, and passes said container through the slot 3 through the door, in the manner shown in FIG. 3, a person 30 (FIG. 1) inside the area enclosed by the door places said container in the receptacle 22, in the manner shown in FIGS. 1 and 4, and said container is secured in said receptacle, in the manner shown in FIGS. 5 to 7, until the door is closed and the securing system is operated by the person 30 inside the area and the visitor 21 outside the door.

A sixth securing device 31 (FIG. 6) cooperates with the indentation 14 and is operated from inside the door.

The first securing device 24 is a spring-biased lug manually movable into and out of the indentation 12.

The second securing device 25 is a pivotally mounted lug manually rotatable into and out of the indentation 13. The third securing device 26 is a pivotally mounted lug of essentially Z shape which is manually rotatable for insertion at one end into the indentation 27 of the door bolt 23, and at the other end, into a slot 32 formed through the container 6. The fourth securing device 28 is a magnetically operated lug which is movable into and out of the indentation 11 via a permanent magnet 32a located in the door jamb 2. The fifth securing device 29 is a pivotally mounted lug rotated into and out of the indentation 15 via an actuating member 33 (FIGS. 6 and 9) in spring-loaded contact with the door jamb 2 in the hinged side of the door 1 (FIG. 10). The sixth securing device 31 is controlled in its movement by a solenoid 34 (FIG. 6) to move into and out of the indentation 14.

A battery 35, pushbutton switch 36 and the solenoid 34 are electrically connected in circuit by electrical conductors 37, 38 and 39 (FIG. 8) in a manner whereby the battery energizes the solenoid under the control of the switch. The sixth securing device 31 is thus controlled from inside the door to overcome antisocial intentions of a pair of visitors functioning as a team.

As hereinbefore stated, the household security device of the invention permits a person within a house, apartment, or the like, to inspect and secure the photographic identification card, or the like, of a visitor, after visual comparison, before unlocking the door. However, more importantly, the device of the invention requires that the door be closed and locked, with the visitor outside and a person within the house, apartment, or the like, inside, working in conjunction to release and return the identification card, or the like.

Thus, with the visitor inside the house, apartment, or the like, the identification card, or the like, is not retrievable, and with the visitor outside the locked door, coercion is physically impossible. Furthermore, a hidden release button system is included to frustrate any attempt by two malefactors working in concert to retrieve the identification card, or the like.

The release of the container 6 is contingent upon the closing and locking of the door, the operation of the first securing device 24 by a person outside the door, and the operation of the sixth securing device 31 by the solenoid 34 under the control of the concealed button or switch operated by the person in the house, apartment, or the like. These criteria must be met simultaneously, due to the interaction of the container 6, the bolt 23 and the various lugs, as hereinafter described.

a. The container 6 may be raised or lowered only when the bolt 23 is in the locked position due to the second securing device 25.

b. The container 6 may be raised or lowered only when the door is closed, due to the hidden permanent magnet **32*a* in the door jamb, controlling the fourth securing device 28**.

c. The container 6 may be raised only when the actuating member 33 is pressed against the hinge jamb, that is, when the door is closed, thereby actuating the fifth securing device 29.

The conditions b and c are mutually redundant, since each backs up the other.

d. The container 6 may be raised only if the first securing device 24 is moved by a person outside the door.

e. The container 6 may be raised only if the solenoid 34 is operated by an electrical circuit actuated by an electrical contact or button which may be concealed.

The aforedescribed conditions a to e must be satisfied simultaneously for the identification card, or the like, to be released. Since conditions b and c are satisfied automatically upon the closing of the door and condition a is satisfied upon the sliding of the bolt 23, the person inside the house, apartment, or the like, need merely operate the hidden switch and the person outside need merely operate the first securing device 24 for the container 6 to be released.

A malefactor attempting to remove the container 6 by brute force would be most likely to do so with the door closed and locked, for privacy and support. If he should succeed, the third securing device 26, which is operated by the presence or absence of the container 6 would enter the indentation 27 of the door bolt 23, effectively locking said bolt in its locked position.

While the invention has been described by means of a specific example and in a specific embodiment, I do not wish to be limited thereto, for obvious modifications will occur to those skilled in the art without departing from the spirit and scope of the invention.

I claim:

1. A household security device for a door movably mounted in a door jamb, the door having a slot formed therethrough, an inside surface and an outside surface, said security device comprising a container of generally rectangular parallelepiped configuration having a pair of spaced substantially planar parallel surfaces each of substantially rectangular configuration with a pair of spaced parallel length edges each having spaced indentations formed therein, one of said surfaces having a slot formed therein, said container having a pair of length sides perpendicular to the surfaces and joining the corresponding edges of said surfaces with indentations formed therein in correspondence with the indentations formed in said edges, and a pair of width sides perpendicular to the surfaces, said container having a chamber therein for accommodating an identification item;

a receptacle mounted on the inside surface of the door in proximity with the slot formed through said door for accommodating the container;

a door bolt extending through the door for releasably securing said door in the door jamb, said door bolt having indentations therein; and securing means in the receptacle and the door for permitting a person in an area enclosed by said door to inspect and secure a photographic identification item of a visitor, after visual comparison, before unlocking said door, said securing means functioning when said door is closed and locked, with the visitor outside the door and the person in the enclosed area working in conjunction with each other to release and return the identification item, said visitor placing said identification item in said container outside said door and said container being drawn through said slot through said door by said person and placed in said receptacle.

2. A household security device as claimed in claim 1, wherein said securing means includes a first securing device, operable by said visitor outside said door, cooperating with a first of said indentations and an additional securing device, operable by said person in said enclosed area, cooperating with a second of said indentations, said first and additional securing devices freeing said container for raising in said receptacle when operated simultaneously.

3. A household security device as claimed in claim 2, wherein said additional securing device comprises a source of electrical energy, a switch, a solenoid, a member affixed to and movable by said solenoid and electrical conductors electrically connecting said source of electrical energy, said switch and said solenoid in circuit for selectively energizing said solenoid with electrical energy via said switch to selectively move said member out of said second of said indentations.

4. A household security device as claimed in claim 2, wherein said securing means further includes a second securing device cooperating with a third of said indentations and coupled to and operated by said door bolt via an indentation in said bolt in a manner whereby said container is raisable and lowerable in said receptacle only when said bolt is in locked position due to said second securing device and a third securing device cooperating with another indentation in said bolt and the slot formed in said container and operated by said bolt.

5. A household security device as claimed in claim 4, further comprising a permanent magnet concealed in said door jamb, and wherein said securing means further includes a fourth securing device cooperating with a fourth of said indentations and operable by the magnet to free said container for raising and lowering in said receptacle when said door is closed.

6. A household security device as claimed in claim 5, wherein said door jamb includes a hinge jamb on which said door is mounted and said seuring means further includes a fifth securing device pivotally mounted to cooperate with a fifth of said indentations, and further comprising a spring-loaded rod mounted on said door and having a first end abutting the hinge jamb and a second spaced opposite end abutting said fifth securing device whereby said rod actuates said fifth securing device to free said container for raising in said receptacle only when said door is closed thereby moving said rod to pivot said fifth securing device and move it out of said fifth of said indentations.

* * * * *